US007509700B2

(12) United States Patent
Speer et al.

(10) Patent No.: US 7,509,700 B2
(45) Date of Patent: Mar. 31, 2009

(54) INSTITUTIONAL MATTRESS

(75) Inventors: Lonna J. Speer, Santa Cruz, CA (US); Donna J. Coomer, Cedar City, UT (US); Robert J. Russell, Midland, MI (US)

(73) Assignee: Ferguson Safety Products, Santa Cruz, CA (US)

( * ) Notice: Subject to any disclaimer, the term of this patent is extended or adjusted under 35 U.S.C. 154(b) by 292 days.

(21) Appl. No.: 11/414,123

(22) Filed: Apr. 28, 2006

(65) Prior Publication Data

US 2007/0251017 A1 Nov. 1, 2007

(51) Int. Cl.
*A47C 27/14* (2006.01)

(52) U.S. Cl. ..... 5/737; 5/698; 5/699; 442/286; 442/293; 428/74; 428/76

(58) Field of Classification Search ..... 5/737, 5/698, 699; 442/286, 293, 123, 136, 168; 428/74, 76

See application file for complete search history.

(56) References Cited

U.S. PATENT DOCUMENTS 6,351,864 B1 3/2002 Karafa et al.
6,516,482 B2 2/2003 Karafa et al.
6,785,923 B2 9/2004 Karafa et al.

OTHER PUBLICATIONS

"Replacement Stretcher and Operating Room Mattresses," 6 pages, dated Mar. 13, 2006, downloaded on May 14, 2008 from www.archive.org.

"Replacement Stretcher and Operating Room Mattresses," 6 pages, downloaded on May 14, 2008 from www.bluechipmedical.com/institutional3.htm.

*Primary Examiner*—Alexander Grosz
(74) *Attorney, Agent, or Firm*—Patent Law Group LLP; David C. Hsia

(57) ABSTRACT

An institutional mattress includes a resilient core and a mattress covering sealing the core. The mattress covering has a ticking with a base fabric made of yarns with a denier value of at least 500 and has a thread count of at least 18 threads per inch in both warp and fill. The ticking is bonded to a fluid proof material having an anti-microbial agent. The core may be fire resistant polymeric foam and the ticking base fabric may be 1050 denier "ballistic" nylon. The ticking base fabric may be coated with urethane having at least one of a flame retardant and an anti-microbial, and then laminated with a polyurethane film. Alternatively, the ticking base fabric may be treated with a flame retardant covered with a fluid proof material. The mattress covering may be sealed around the core with stitching.

7 Claims, 1 Drawing Sheet

INSTITUTIONAL MATTRESS

FIELD OF INVENTION

This invention relates to a mattress and particularly to an institutional mattress.

DESCRIPTION OF RELATED ART

In a correctional facility, an inmate that has demonstrated suicidal tendencies requires special attention. The vast majority of suicides occur through "hanging," which includes strangulation. Once an inmate is identified as being suicidal, the proper procedure is typically to place the inmate in a specially designed, stripped-down cell—one with no protrusions, no furniture, and preferably padded walls. With no bed, the inmate must sleep on the cold, hard floor. The padding and insulating functions of a mattress that could not be tom apart would benefit both the inmate and staff in multiple ways, including an earlier return of the inmate to the general housing and a reduction in the risk of facility liability.

Any mattress to be used with suicidal inmates needs to be as impervious to destruction by teeth and hands as possible. The various kinds of ticking of current correctional mattresses, however, can too easily be torn into strips to fashion a noose with which to commit suicide.

Mattresses for high security and destructive inmates would benefit from the same tear-resistance. Current correctional mattresses are easily damaged by puncturing with tools fashioned by inmates. Inmates often cut or tear open their mattresses to crawl inside for warmth, to hide contraband, or merely to destroy facility property.

Mattresses for other institutions, such as school dormitories and armed forces barracks, are also often damaged by their users and would benefit from exceptional tear-resistance.

Institutional mattress coverings must be able to be disinfected using standard cleaning agents. Institutional mattress coverings must also be fluid-proof to prevent the introduction of cleaning liquids and bodily fluids. Due to state codes and institutional requirements, the mattress must pass various flammability tests. While these are the minimum requirements, there are numerous other desirable characteristics such as general durability, a color upon which blood is visible, antimicrobial surface, "foldability" so that the mattress may be searched for contraband, sufficient stiffness to prevent the mattress from being folded easily to make a shield, and abrasion resistance for longevity when used on a rough surface.

Attempts to solve the above problems have generally been a covering of heavy vinyl with a scrim of approximately nine threads per inch of heavy yarns. Others have used stretchable material with a knit fabric of finer threads as the base fabric. Others have used clear vinyl so that contraband can be seen between the core and the covering. Nevertheless correctional officials still struggle with the lack of a mattress that cannot be destroyed by hand.

U.S. Pat. Nos. 6,351,864, 6,516,482, and 6,785,923 (hereafter collectively as the "Derby patents") disclose an institutional bedding with integrated compressible foam mattress pad and two compressible foam pillows within a fluid resistant or impermeable covering having heat sealed seams. The foam mattress and foam pillows are made from urethane foam and the cover is made from Dartex P338 Cromarty polyurethane material. The cover can also be made from nylon 6 warp knitted fabric with a polyurethane transfer coating, vinyl based or vinyl coated materials, or PVC or polyolefin laminated or coated fabric, or other heat sealable covering material with antibacterial, antifungal, and fluid penetration resistant characteristics. The seams of the covering is preferably heat sealed by radio frequency, thermal, or sonic welding, or sealed by chemical, adhesive, or cement bonding according to the materials used for the covering. The foam pillows can be separated by an inflatable bladder or a spacer.

SUMMARY

An institutional mattress includes a resilient core and a mattress covering sealing the core. The mattress covering has a ticking with a base fabric that is made of yarns with a denier value of at least 500 and has a thread count of at least 18 yarns per inch in both warp and fill. The ticking is bonded to a fluid proof material having an anti-microbial agent. In one embodiment, the core is of fire resistant polymeric foam. In one embodiment, the ticking base fabric is 1050 denier "ballistic" nylon. In one embodiment, the ticking base fabric is first coated with urethane having at least one of a flame retardant and an anti-microbial, and then laminated with a polyurethane film. In another embodiment, the ticking base fabric is treated with a flame retardant and covered with a fluid proof material. In one embodiment, the mattress covering is sealed around the core with stitching.

BRIEF DESCRIPTION OF THE DRAWINGS

Use of the same reference numbers in different figures indicates similar or identical elements.

DETAILED DESCRIPTION OF THE INVENTION

Figure 1:
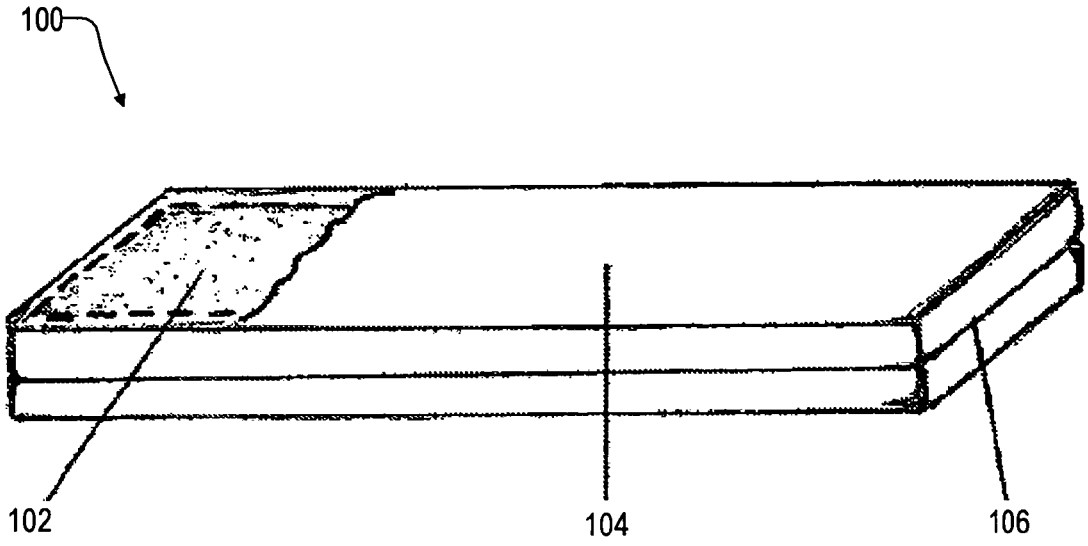
FIG. 1 illustrates an institutional mattress in one embodiment of the invention.

FIG. 1 illustrates an institutional mattress 100 in one embodiment of the invention. Institutional mattress 100 balances safety and comfort for use in a variety of institutional settings. Institutional mattress 100 includes a resilient inner core 102 illustrated in a partial cutaway. In one embodiment, inner core 102 is of fire resistant polymeric foam. Such foam is available from Chestnut Ridge Foam, Inc. of Latrobe, Pa.

A mattress covering 104 encloses inner core 102. Mattress covering 104 is made of a waterproof ticking. The ticking has a base fabric that is made of yarns with a denier value of at least 500 and has a thread count of at least 18 threads per inch in both warp and fill. This combination of denier value and thread count is higher than any institutional mattress known to the inventors. Examples of the ticking base fabric include 1000 denier nylon and 1050 denier "ballistic" nylon.

Seams 106 of mattress covering 104 may be sealed by lockstitch sewing. In one embodiment, all seams are double stitched and some seams are further top stitched. The stitching thread is of a synthetic fiber, such as nylon, aramid (e.g., Kevlar or Twaron), Spectra, or a combination thereof. Alternatively, seams 106 can be sealed by thermal welding, radiofrequency sealing, ultrasonic welding, adhesive bonding, or other similar sealing methods.

In one embodiment, the ticking is coated with urethane having at least one of a flame retardant and an anti-microbial, and then laminated with a polyurethane film for waterproofing and abrasion resistance. The ticking may be coated and laminated with techniques developed by Laminating Coating Technologies, Inc. (dba Lamcotec) of Monson, Me.

In one embodiment, the ticking is 1050 ballistic nylon having the following characteristics.

| Characteristics | Value |
|---|---|
| Finished weight | 19.5 ± 0.5 oz per square yard |
| Denier | 1050 |
| Thread count | 22 to 23 yarns per inch in both warp and fill (in a basketweave stitch where two yarns are woven together and counted as one in the thread count measurement) |
| Coating and laminate | Coated with urethane and then laminated with polyurethane film |
| Sealing method | Double stitched and top stitched with tex 70 nylon thread |

Figure 2:
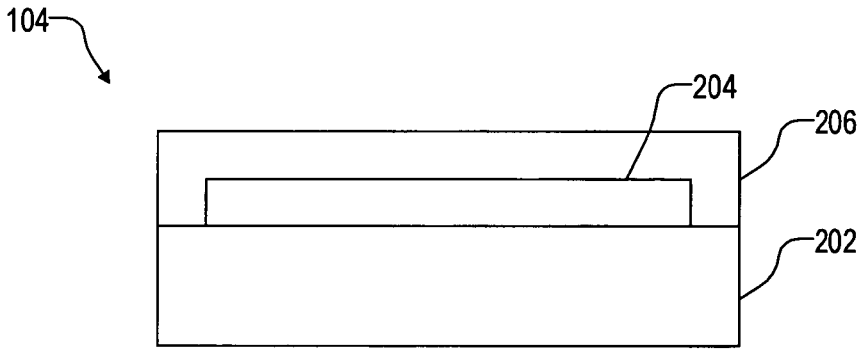
FIG. 2 illustrates a mattress covering of the institutional mattress of FIG. 1 in one embodiment of the invention.

FIG. 2 illustrates a cross-section of an alternative embodiment of mattress covering 104. Mattress covering 104 is made of a ticking having a base fabric 202 that is made of yarns with a denier value of at least 500 and has a thread count of at least 18 yearns per inch in both warp and fill. Examples of the ticking include 1000 denier nylon and 1050 denier "ballistic" nylon.

Instead of having a coating treated with a flame retardant, base fabric 202 itself is treated with a flame retardant 204. Flame retardant 204 may be sprayed on, brushed on, rolled on, or by soaking base fabric 202. Flame retardant 204 may be FlameStop I-DS™ by Flame Stop, Inc. of Ft. Worth, Tex., Orco Flame Retardant XF100 by Orco of East Providence, R.I., or any of a number of borax based flame retardants such as Firebrake ZB by US Borax Inc. of Valencia, Calif. Base fabric 202 is also coated and/or laminated with a waterproof material 206. Waterproof material 206 may be urethane or polyvinyl chloride (PVC).

Note that flame retardant 204 may be semi-durable or nondurable (i.e., it may be washed away within 50 launderings) because waterproof material 206 shields base fabric 202 and flame retardant 204 from the dissolving effects of fluid. Thus, mattress covering 104 may be washed with a liquid cleaning agent while retaining its fire resistant property.

Various other adaptations and combinations of features of the embodiments disclosed are within the scope of the invention. Numerous embodiments are encompassed by the following claims.

What is claimed is:

1. An institutional mattress, comprising:

a resilient core; and a mattress covering sealing the resilient core, the mattress covering comprising a ticking treated with a flame retardant, the ticking comprising a base fabric that is made of yarns with a denier value of at least 500 and has a thread count of at least 18 threads per inch in both warp and fill, the ticking being bonded to a fluid proof material having an anti-microbial agent.

2. The institutional mattress of claim 1, wherein the base fabric is selected from the group consisting of a 1000 denier nylon and a 1050 denier ballistic nylon.

3. The institutional mattress of claim 1, wherein the mattress covering is sealed around the resilient core by lockstitch sewing.

4. The institutional mattress of claim 1, wherein the mattress covering is sealed around the resilient core with one of thermal welding, radiofrequency sealing, ultrasonic welding, and adhesive.

5. The institutional mattress of claim 1, wherein the fluid proof material is urethane and the base fabric is coated with the urethane, the urethane having at least one of the flame retardant and the anti-microbial agent.

6. The institutional mattress of claim 5, wherein the base fabric is further laminated with a polyurethane film.

7. The institutional mattress of claim 1, wherein the base fabric is treated with the flame retardant, and the fluid proof material covers the base fabric.

* * * * *